United States Patent [19]

Murasaki

[11] Patent Number: 4,838,495

[45] Date of Patent: Jun. 13, 1989

[54] APPARATUS FOR STARTING ROTATION OF TAPE-SUPPLY SPOOL

[75] Inventor: Ryuichi Murasaki, Toyama, Japan

[73] Assignee: Yoshida Kogyo K.K., Tokyo, Japan

[21] Appl. No.: 186,808

[22] Filed: Apr. 27, 1988

[30] Foreign Application Priority Data

Apr. 27, 1987 [JP] Japan ..... 62-63666[U]

[51] Int. Cl.[4] ..... B65H 16/00; F16H 32/00

[52] U.S. Cl. ..... 242/55; 242/65; 242/192; 74/128; 74/206

[58] Field of Search ..... 242/55, 192, 65, 66; 74/8, 128, 206; 414/24.6, 911

[56] References Cited

U.S. PATENT DOCUMENTS

| | | | |
|---|---|---|---|
| 2,905,406 | 9/1959 | Falck-Pedersen | 242/75.43 |
| 3,081,957 | 3/1963 | Van de Bilt | 242/156.2 |
| 3,300,697 | 1/1967 | Woodford | 74/128 |
| 3,395,585 | 8/1968 | Obermann | 74/124 X |
| 3,602,448 | 8/1971 | Muensterer | 242/55 |
| 4,267,740 | 5/1981 | Schwarz | 74/128 |

*Primary Examiner*—Stuart S. Levy
*Assistant Examiner*—Steven M. DuBois
*Attorney, Agent, or Firm*—Hill, Van Santen, Steadman & Simpson

[57] ABSTRACT

An apparatus for starting rotation of a non-driven tape-supply spool comprises a lever pivotally connected at its base to one side of a frame by a pivot, a first cylinder pivotally connected at its base to the same side of the frame by the same pivot and having a first piston rod, a second cylinder fixedly mounted on the other side of the frame and having a second piston rod pivotally connected at its distal end to a midportion of the lever via a link, and a kick-out arm pivotally connected at its base to a distal end of the lever and at its head to a distal end of the first piston rod of the first cylinder. By a combined motion of pivotal movement of the lever and the kick-out arm in response to the action of the first and second cylinders, the head of the kick-out arm is moved so as to push the spool on its peripheral edge to start rotation of the spool.

6 Claims, 3 Drawing Sheets

APPARATUS FOR STARTING ROTATION OF TAPE-SUPPLY SPOOL

BACKGROUND OF THE INVENTION

1. Field of the Invention

The present invention relates to an apparatus for starting rotation of a non-driven spool on which a tape such as a large-width semi-product tape for touch-and-close or surface-type fasteners is wound.

2. Description of the Prior Art

Generally, in the manufacture of touch-and-close or surface-type fasteners for example, a roll of large-width semi-product tape wound on a large-sized non-driven spool is reeled off the spool and is fed to a subsequent processing station, such as for washing, dyeing or cutting, as the leading portion of the tape is retracted by a pair of driven feed rollers. However, since inertia of the loaded spool is very large especially when the roll of the tape is large and heavy, the spool is difficult to start rotation solely by the driving force of the feed rollers which is limited in amount. To this end, an attendant or workperson is needed to push the spool in the circumferential direction by hand to assist in starting the driven rotation of the spool by the feed rollers; such manual rotation is laborious and dangerous. Other problems with this conventional practice are: that the tape can be easily damaged causing inadequate quality products; that the motor can be easily damaged due to overload; and that the feeding rate of the tape is changeable. Consequently a required rate of production is difficult to achieve.

SUMMARY OF THE INVENTION

It is therefore an object of the present invention to provide an apparatus for starting rotation of a large-sized non-driven spool smoothly without any damage to either the tape or the driving system for tape-feeding, thus guaranteeing accurate feeding of the tape to a subsequent processing station. This apparatus is particularly suitable for use in starting rotation of the spool especially when the roll of the tape is large and heavy. According to the present invention, an apparatus for starting rotation of a non-driven spool comprises a frame, a lever a base of which is pivotally mounted on one side of the frame by a pivot, a first cylinder a base of which is pivotally mounted on the same side of the frame by the pivot, a kick-out arm pivotally connected at its base to a distal end of the lever and at its head to a distal end of a first piston rod of the first cylinder, a second cylinder horizontally mounted on the other side of the frame and having a second piston rod pivotally connected at its distal end to a midportion of the lever via a link. The kick-out arm is angularly movable about the distal end of the lever by the action of the first cylinder, while the lever is pivotally movable about the pivot at the base of the lever by the action of the second cylinder. For starting, by a combined motion of the pivotal movements of the kick-out arm and the lever, the head of the kick-out arm is moved forwardly along a predetermined locus to push the peripheral surface of the spool so as to rotate the spool. After the rotation of the spool has been started, by the combined motion of the pivotal movements of the kick-out arm and the lever, the head of the kick-out arm is returned to its original position away from the peripheral surface of the spool along a different locus.

Many other objects, features and additional advantages of the present invention will become manifest to those versed in the art upon making reference to the detailed description and the accompanying sheets of drawings in which preferred structural embodiment incorporating the principle of the present invention is shown by way of illustrative example.

DETAILED DESCRIPTION

Figure 1:
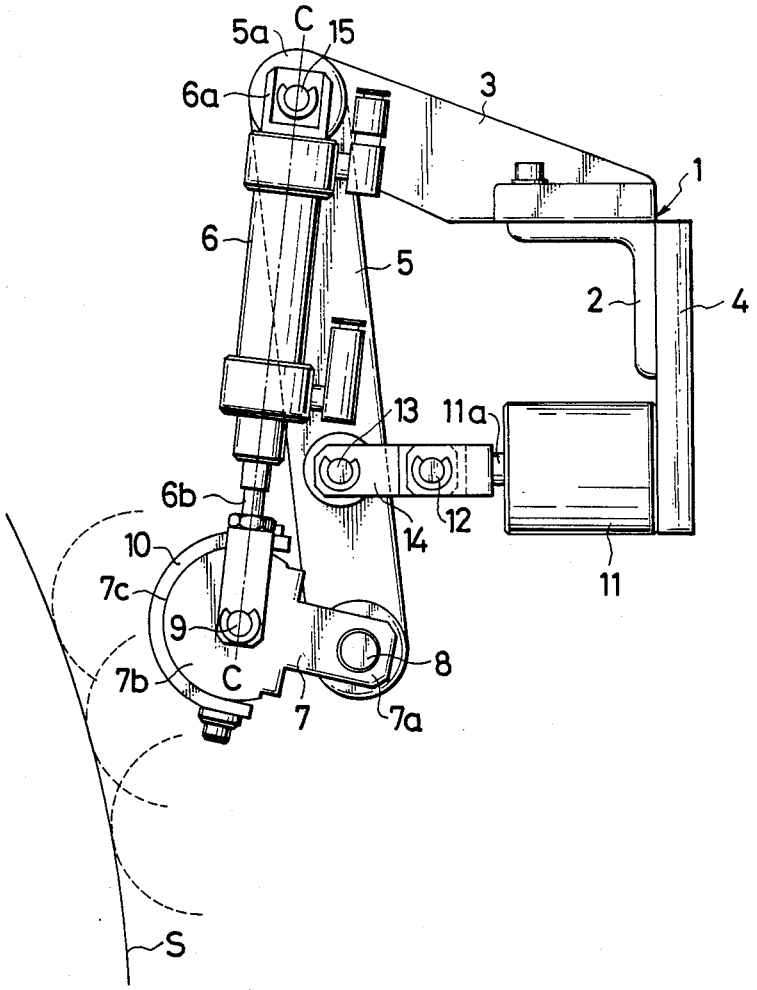
FIG. 1 is a plan view of a spool-rotation starting apparatus embodying the present invention.
Figure 2:
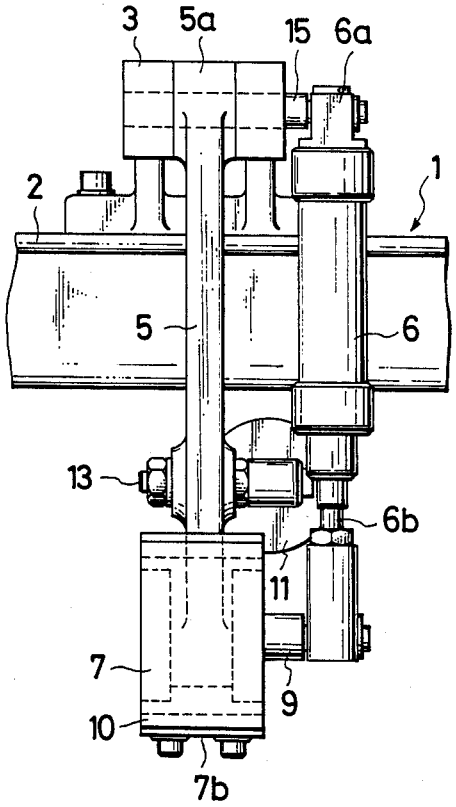
FIG. 2 is a side elevational view of FIG. 3.

The principle of the present invention is particularly useful when embodied in a spool-rotation starting apparatus (hereinafter referred to as "apparatus") such as shown in FIGS. 1 and 2.

The apparatus generally comprises a lever 5 horizontally pivotable about a pivot 15, a first cylinder 6 horizontally pivotable about the pivot 15, a second cylinder 11 for pivotally moving the lever 5, and a kick-out arm 7 pivotally connected at its base **7*a* to one end of the lever 5 by a first pin 8 and at its head 7*b* to a distal end of a first piston rod 6*b* of the first cylinder 6 by a second pin 9**.

The lever 5 is pivotally connected at its base 5a to a bracket 3 by the pivot 15, the bracket 3 being fixedly attached to one side of a support post 2 of L-shaped cross section of a frame 1. The first cylinder 6 also is pivotally connected at its base **6*a* to the bracket 3 by the same pivot 15, the base 6*a* being spaced from the base 5*a* of the lever 5 by a predetermined distance along the pivot 15**.

The second cylinder 11 is horizontally supported on a support plate 4 fixedly attached to the other side of the frame 1 and has a second piston rod **11*a* pivotally connected at its distal end to a midportion of the lever 5 via a link 14 by third and fourth pins 12, 13**.

In the illustrated embodiment, each of the first and second cylinders 6, 11 is an air cylinder which uses compressed air, but may be a liquid cylinder which uses oil or water.

The head **7*b* of the kick-out arm 7 has an arcuate end surface 7*c* to which a friction shoe 10** such as of leather, rubber or synthetic resin is attached.

Figure 3:
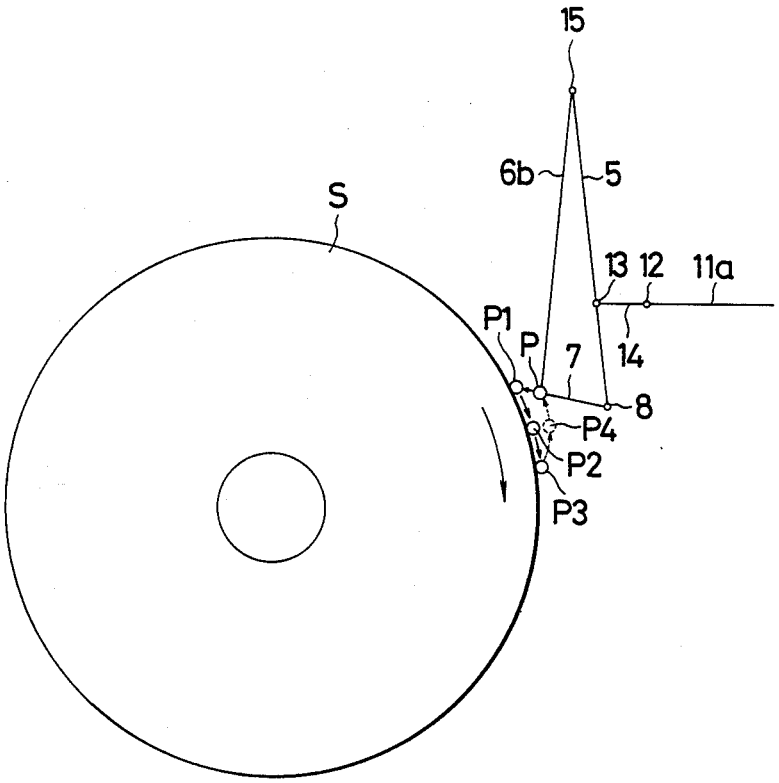
FIG. 3 is a schematic plan view showing the manner in which a head of a kick-out arm is moved to start rotation of a spool.

Before the starting operation, as shown in FIG. 3, the apparatus is positioned in such a manner that the friction shoe 10 of the kick-out arm 7 is disposed at a point P (FIG. 3) spaced a predetermined distance from the peripheral edge of a spool S, at which time the axis C—C of the first cylinder 6 extends substantially tangentially of the peripheral edge of the spool S, and that as the second piston rod **11*a* of the second cylinder 11 is expanded to the maximum, the friction shoe 10 of the kick-out arm 7 is moved to a start point P1 to contact the peripheral edge of the spool S, and that as the first piston rod 6*b* of the first cylinder 6 is expanded to the maximum, the friction whoe 10 of the kick-out arm 7 is moved to a terminal point P3 to contact the peripheral edge of the spool S. At the point P both the first and second piston rods 6*a*, 11*a* of the first and second cylinders 6, 11** are retracted to the maximum.

In operation, with the shoe 10 of the kick-out arm 7 disposed at the point P, as the second piston rod **11*a* of the second piston rod 11 is expanded forwardly, the lever 5 is pivotally moved clockwise to push the shoe 10 of the kick-out arm 7 from the point P to the start point P1 where the shoe 10** is in contact with the peripheral edge of the spool S.

Subsequently, with the shoe 10 of the kick-out arm 7 disposed at the starting point P1, as the first piston rod **6*b* of the first cylinder 6 is expanded forwardly, the kick-out arm 7 is pivotally moved counterclockwise about the first pin 9, in response to which the second piston rod 11*a* of the second cylinder 11 is retracted to a slight extent slowly. This retracting causes the lever 5 to pivotally move counterclockwise about the pivot 15. By a combined motion of the pivotal movements of the lever 15 and the kick-out arm 7, the shoe 10 of the pick-out arm 7 is moved from the start point P1 to the terminal point P3 via an intermediate point P2** along a predetermined locus, pushing the spool S so as to cause the same to rotate in the direction of an arrow. Thus rotation of the spool S has been started.

After starting of rotation of the spool S, the first piston rod **6*b* of the first cylinder 6 is retracted to cause the kick-out arm 7 to pivotally move counterclockwise about the first pin 8, during which time the second piston rod 11*a* of the second cylinder 11 continues retracting to cause the lever 5 to pivotally move counterclockwise about the pivot 15. As a result, the shoe 10 of the kick-out arm 7 is removed from the peripheral edge of the spool S and is returned to the original point P from the terminal point P3 via another intermediate point P4** along a different predetermined locus. Thus a single cycle of the starting operation of the apparatus has been completed.

Practically, the amount of moment of rotation required for starting of the spool S varies within a considerably wide range depending on the amount of the wound tape, the diameter of the spool and the amount of the driving force of the driven feed rollers of a subsequent processing station. In such event the above-described cycle of starting operation may be repeated until an adequate amount of moment of rotation can be achieved.

Alternatively, more than one spool-rotation starting apparatus of this construction may be used in side-by-side arrangement in order to start more than one spool simultaneously.

Although various minor modifications may be suggested by those versed in the art, it should be understood that I wish to embody within the scope of the patent granted hereon, all such embodiments as reasonably and properly come within the scope of my contribution to the art.

What is claimed is:

1. An apparatus for starting rotation of a non-driven spool, comprising:

(a) a frame;

(b) a lever having a base pivotally supported on one side of said frame by a pivot;

(c) a first cylinder having a base pivotally supported on said one side of said frame by said pivot, said first cylinder having a first piston rod;

(d) a second cylinder fixedly supported on the other side of said frame and having a second piston rod pivotally connected at its distal end to a midportion of said lever via a link; and (e) a kick-out arm pivotally connected at its base to a distal end of said lever and at its head to a distal end of said first piston rod of said first cylinder.

2. An apparatus according to claim 1, in which said head of said kick-out arm has an arcuate end surface.

3. An apparatus according to claim 2, in which said kick-out arm further has a friction shoe attached to said arcuate end surface of said head for contacting a peripheral edge of the spool S.

4. An apparatus according to claim 3, in which said friction shoe comprises leather.

5. An apparatus according to claim 3, in which said friction shoe comprises rubber.

6. An apparatus according to claim 3, in which said friction shoe comprises synthetic resin.

* * * * *